US008870602B2

(12) United States Patent
Cook et al.

(10) Patent No.: US 8,870,602 B2
(45) Date of Patent: Oct. 28, 2014

(54) COMBINATION OF RADIO FREQUENCY, HIGH SPEED DIGITAL COMMUNICATION, AND DIRECT CURRENT SIGNALS IN A SINGLE CABLE ASSEMBLY

(75) Inventors: Jason Cook, Irvine, CA (US); Tim Gossard, Eastvale, CA (US); James K. Custer, Folsom, CA (US)

(73) Assignee: Powerwave Technologies S.a.r.L., Luxembourg (LU)

( * ) Notice: Subject to any disclaimer, the term of this patent is extended or adjusted under 35 U.S.C. 154(b) by 0 days.

(21) Appl. No.: 13/549,183

(22) Filed: Jul. 13, 2012

(65) Prior Publication Data

US 2013/0016493 A1 Jan. 17, 2013

Related U.S. Application Data

(60) Provisional application No. 61/507,808, filed on Jul. 14, 2011.

(51) Int. Cl.

| | |
|---|---|
| ***H01R 31/06*** | (2006.01) |
| ***H01R 13/514*** | (2006.01) |
| ***H01R 27/02*** | (2006.01) |

(52) U.S. Cl.

CPC ..... *H01R 13/514* (2013.01); *H01R 31/06* (2013.01); *H01R 27/02* (2013.01)

USPC ..... 439/660

(58) Field of Classification Search

USPC ..... 439/701, 364, 248, 249, 660, 589, 189, 439/488

See application file for complete search history.

(56) References Cited

U.S. PATENT DOCUMENTS

| | | | | |
|---|---|---|---|---|
| 5,314,357 | A * | 5/1994 | Weidler | 439/701 |
| 5,814,905 | A * | 9/1998 | Tang | 307/147 |
| 6,535,397 | B2 * | 3/2003 | Clark et al. | 361/788 |
| 6,582,255 | B2 * | 6/2003 | Simmons et al. | 439/701 |
| 7,029,290 | B2 * | 4/2006 | Wu | 439/76.1 |
| 7,037,131 | B1 * | 5/2006 | Chen et al. | 439/372 |
| 7,090,521 | B2 * | 8/2006 | Nishio et al. | 439/248 |
| 2002/0146926 | A1 * | 10/2002 | Fogg et al. | 439/362 |

* cited by examiner

*Primary Examiner* — Alexander Gilman

(74) *Attorney, Agent, or Firm* — Caseiro Burke LLC; Chris A. Caseiro

(57) ABSTRACT

An electrical connector assembly or cable assembly that carries a combination of radio frequency signals, high speed digital communication signals, and direct current DC power signals is disclosed. The electrical connector assembly exhibits environmental protection. Other features include providing blind mate connection that may be used in a radio transport or fiber transport repeater system for a wireless network.

19 Claims, 8 Drawing Sheets

COMBINATION OF RADIO FREQUENCY, HIGH SPEED DIGITAL COMMUNICATION, AND DIRECT CURRENT SIGNALS IN A SINGLE CABLE ASSEMBLY

RELATED APPLICATION INFORMATION

The present application claims priority under 35 U.S.C. Section 119(e) to U.S. Provisional Patent Application Ser. No. 61/507,808 filed Jul. 14, 2011, the disclosure of which is incorporated herein by reference in its entirety.

BACKGROUND OF THE INVENTION

1. Field of the Invention

The present invention relates in general to communication systems and components.

More specifically, the present invention relates to interconnection assemblies for communication systems.

2. Description of the Prior Art and Related Background Information

Modern wireless and fiber optic systems may employ interconnected modular components. These systems may be built by combining components best suited for a specific application. These systems may require external interconnects to provide RF and digital communication signals among the components. However, external interconnects may exhibit unwanted properties such as electromagnetic interference and damage as a result to exposure to the elements.

According, a need exists to improve interconnects for wireless and fiber optic systems.

SUMMARY OF THE INVENTION

In a first aspect, the present invention provides an electrical connector assembly, comprising a housing having a cavity which defines a mating opening on a mating end and a coupling opening at an opposite end, a plurality of RF connectors disposed within the housing near the mating opening, and at least one power connector disposed within the first housing near the mating opening. The electrical connector assembly further comprises a plurality of digital communication connectors disposed within the first housing near the mating opening, a first header securing the RF connectors and the power connector, the first header coupled to the housing, and a second header securing the digital communication connectors, the second header coupled to the housing.

In a preferred embodiment, the first header further comprises a first mounting surface and a first set of floating mount washers, the first set of floating mount washers allowing movement of the first header in a plane parallel with the first mounting surface. The second header preferably further comprises a second mounting surface and a second set of floating mount washers, the second set of floating mount washers allowing movement of the second header in the plane parallel with the second mounting surface. The electrical connector assembly preferably further comprises a plurality of insulated wires each electrically coupled to a corresponding digital communication connector, each insulated wire twisted about an adjacent insulated wire. Each insulated wire is preferably twisted a minimum of 5 twists per inch about an adjacent insulated wire. The RF connectors are preferably disposed linearly in the first header, where the RF connectors conducting signals having a high power level surround RF connectors conducting signals having a lower power level. The housing preferably further comprises a recessed groove formed around a perimeter of the opening in the housing, two or more tabs coupled to the housing and extending away from the opening, each tab having a through hole, and two or more mechanical fasteners each held captive in a corresponding through hole in the tabs. The first header preferably comprises a single inline header and the second header comprises a dual inline header.

In another aspect, the present invention provides an electrical connector assembly, comprising a first rigid housing having a first cavity which defines a first opening on a first mating surface, the first rigid housing securing a plurality of first connectors including a plurality of first RF connectors, a first power connector, and a plurality of first digital communication connectors, the first rigid housing having a first header securing the first RF connectors and the first power connector, the first rigid housing having a second header securing the first digital communication connectors, the first rigid housing enclosing a plurality of conductors wherein the connectors are electrically coupled to a corresponding conductor. The electrical connector assembly further comprises a second rigid housing having a second cavity which defines a second opening on a second mating surface, the second rigid housing securing a plurality of second connectors including a plurality of second RF connectors, a second power connector, and a plurality of second digital communication connectors, the second rigid housing having a third header securing the second RF connectors and the second power connector, the second rigid housing having a fourth header securing the second digital communication connectors, the second connectors electrically coupled to the corresponding conductors. The electrical connector assembly further comprises a hollow flexible tubular section expandable in a length direction and coupling the first rigid housing to the second rigid housing, the flexible tubular section enclosing and providing a path for the conductors.

In a preferred embodiment, the first header further comprises a first set of floating mount washers, the first set of floating mount washers allowing movement of the first header in a plane parallel with the mounting surface. The second header preferably further comprises a second set of floating mount washers, the second set of floating mount washers allowing movement of the second header in the plane parallel with the mounting surface. The third header further comprises a third set of floating mount washers, the third set of floating mount washers allowing movement of the third header in the plane parallel with the mounting surface. The fourth header preferably further comprises a fourth set of floating mount washers, the fourth set of floating mount washers allowing movement of the fourth header in the plane parallel with the mounting surface. Each conductor coupled to the digital communication connector is preferably twisted about an adjacent conductor coupled to the digital communication connector. Each conductor coupled to the digital communication connector is preferably twisted a minimum of 5 twists per inch about an adjacent conductor coupled to the digital communication connector. RF connectors conducting signals having a high power level preferably surround RF connectors conducting signals having a lower power level. Each of the first and second housings preferably further comprises a recessed groove formed around a perimeter of each of the openings in the housing, the groove having a depth parallel with a mating direction generally perpendicular to the mating surface, two or more tabs coupled to each of the housings and extending away from the opening, each tab having a thorough hole formed in the mating direction, and two or more mechanical fasteners each held captive in a corresponding through hole in the tabs. The first header preferably comprises a single inline header and the second header comprises a dual inline header.

In another aspect, the present invention provides a modular electronics and electrical connector assembly, comprising a first electronics module, and a first rigid housing removably coupled to the first electronics module having a first cavity which defines a first opening on a first mating surface, the first rigid housing having a first header securing a plurality of first RF connectors, the first rigid housing having a second header securing the first digital communication connectors, the first rigid housing enclosing a plurality of conductors wherein the first RF and first digital communication connectors are electrically coupled to a corresponding conductor. The modular electronics and electrical connector assembly further comprises a second electronics module, a second rigid housing removably coupled to the second electronics module and having a second cavity which defines a second opening on a first mating surface, the second rigid housing having a third header securing a plurality of second RF connectors, the second rigid housing having a fourth header securing the first digital communication connectors, the second RF digital communication connectors electrically coupled to the corresponding conductors, and a flexible tubular section coupling the first rigid housing to the second rigid housing, the flexible tubular section enclosing and providing a path for the conductors.

In a preferred embodiment, the modular electronics and electrical connector assembly further comprises means for providing a blind mate connection of the first housing to a communication system, means for providing environmental protection of a connection of the first housing to the communication system, and means for providing RF isolation of the RF connectors and conductors. The means for providing a blind mate connection of the first housing to the communication system preferably include the first header having a first set of floating mount washers and the second header having a second set of floating mount washers. The means for providing environmental protection of a connection of the first housing to a communication system preferably includes a recessed groove formed around a perimeter of the first opening in the first housing, the groove having a depth parallel with the mating direction, and a sealing gasket disposed in the groove. The means for providing RF isolation of the RF connectors and conductors preferably include RF connectors disposed linearly in the first and second headers, wherein RF connectors conducting signals having a high power level surround RF connectors conducting signals having a lower power level. The system comprising the coupled first and second electronics modules preferably comprises a modular RF repeater.

Further features and aspects of the invention are set out in the following detailed description.

DETAILED DESCRIPTION OF THE INVENTION

Features and advantages of exemplary embodiments will be appreciated from the following detailed description. Embodiments provide a cable assembly or electrical connector assembly that transports radio frequency ("RF") signals, high speed digital communication signals, and direct current such as DC power signals in a single protection classification IP 65 blind mate cable assembly that provides all the signal functions required in both a radio transport ("RT") and fiber transport ("FT") repeater system.

In carrying out these and other objectives, features, and advantages of the exemplary embodiments, a single cable assembly can be used to transport all signal types required between modules in a repeater assembly used in a wireless network system.

Figure 1:
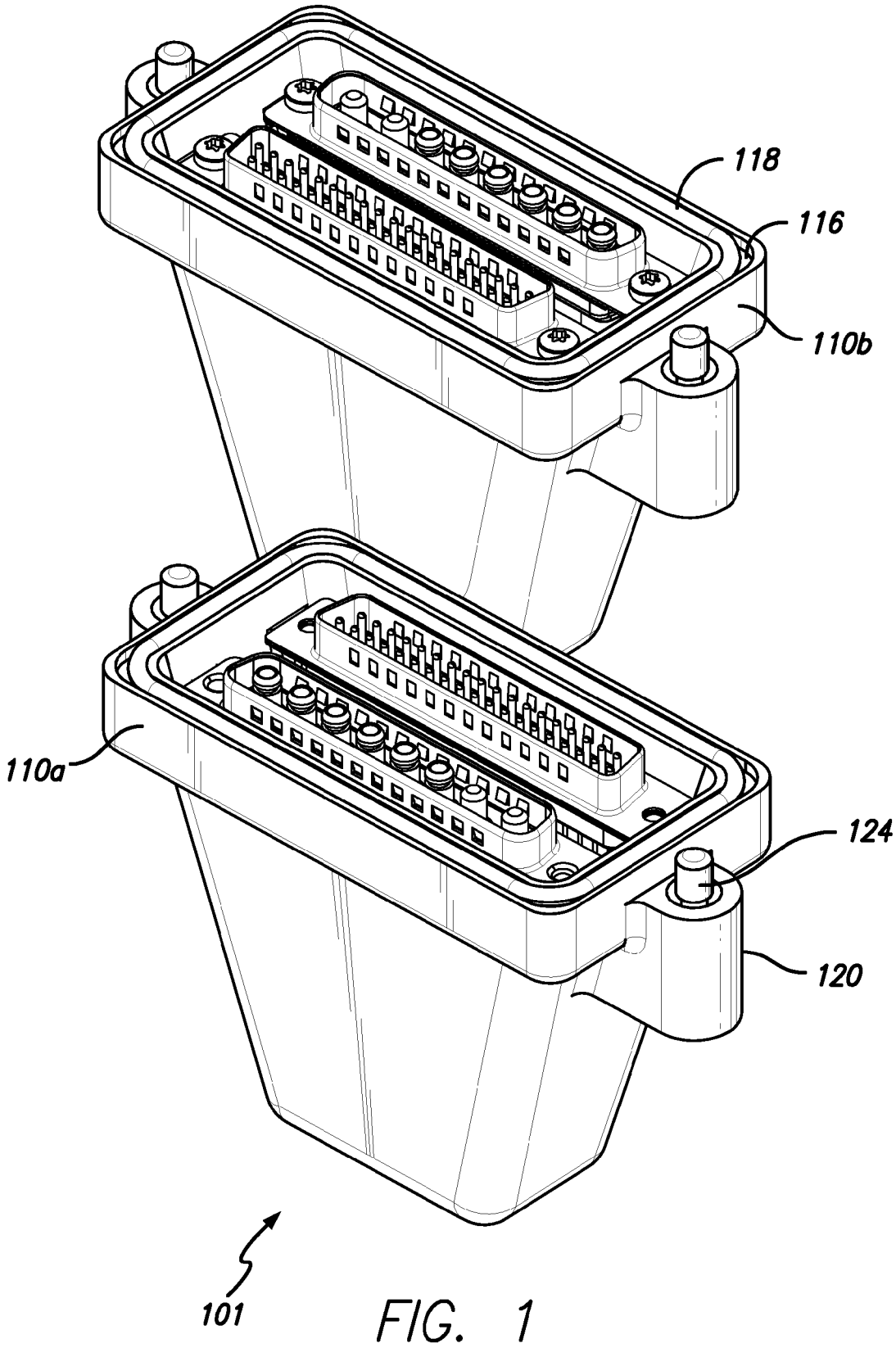
FIG. 1 is an isometric view of an electrical connector assembly in a preferred embodiment of the invention.

FIG. 1 shows an isometric depiction of an exemplary electrical assembly 101 for carrying RF signals, high speed digital communication signals, and direct current DC power signals to transport all required signals from an RF module to another RF module or to a base unit or controller unit in a radio transport or fiber transport repeater wireless system.

Figure 2:
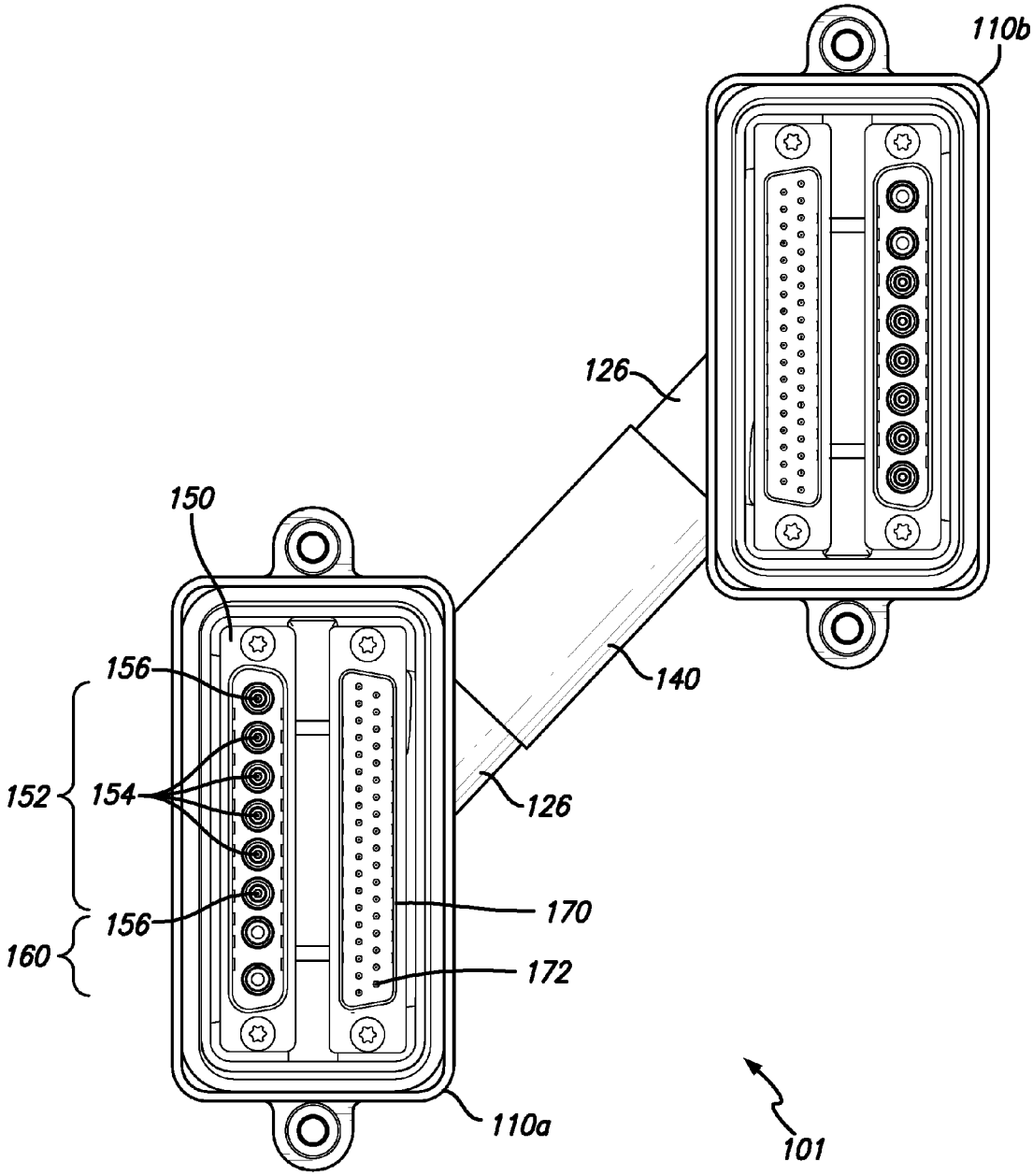
FIG. 2 is a top view of the electrical connector assembly showing "floating" connector headers that make up the blind mate connector/cable assembly. The view also shows the captive fastener locations for securing the blind mate connection to the receptacle.

FIG. 2 shows a top view of the above mentioned cable assembly or electrical connector assembly 101 in one embodiment. This view shows that the electrical connector assembly 101 or cable assembly provides RF and power headers 150 for six radio frequency connectors 152. These RF connectors 152 may be radio frequency coaxial or co-planar transmission lines. The electrical connector assembly 101 or cable assembly supports high frequency RF signals with low loss, for example, having a frequency up to 3 GHz and a minimum return loss of 20 dB for each connection path. In addition, the connections also provide a minimum radio frequency isolation of RF paths of preferably 40 dB minimum between adjacent RF connection paths and a radio frequency isolation of 60 dB minimum between non-adjacent RF connection paths. In addition, included in the same environmental protection classification IP 65 connector housing are the digital communication headers 170 for the high speed digital communication connectors 170 and direct current DC power connections 160. The high speed digital connections support four Ethernet connections 10/100 Base T with 100 ohm impedance. Also included in the communication signals are connections for voltage with a maximum current of 1 amp and Inter IC ("I2C") and synchronization connections. Finally, all direct current DC power connections are provided with a 16 Ampere maximum current capacity. The cable assembly design also meets all Federal Communications Commission ("FCC") and European Telecommunications Standards Institute ("ETSI") standards in regards to electromagnetic interference ("EMI") and electromagnetic compatibility ("EMC") leakage requirements. This represents all the signal types, variety, and performance specifications that are required for the connection between a RF module and another RF module or an RF module to a base unit or controller unit in a radio transport or fiber transport repeater network system.

FIG. 2 also shows that all the connections for the RF signals, the high speed digital communication signals, and the direct current DC power signals are housed on a floating style connector header discussed below. The floating connector allows for movement in the X and Y axis making a blind mate connection possible to the mating connection. No alignment pins or other alignment features are required for the blind mate connection of the hood to the mating piece. FIG. 2 also shows the intended fastening mechanism for the cable assembly to the mating receptacle to captive screw hardware.

Figure 3:
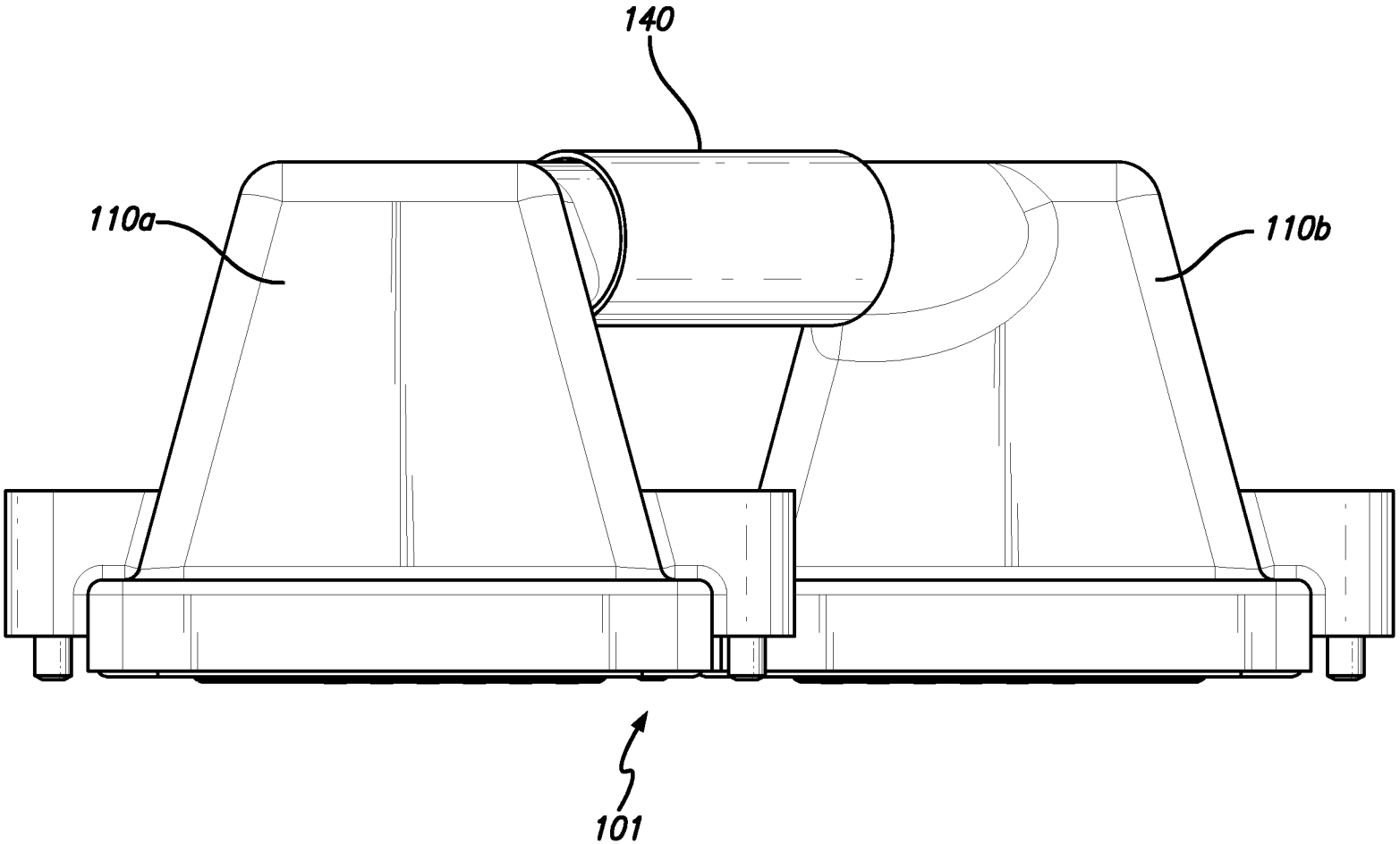
FIG. 3 is a side view of the electrical connector assembly showing the electrical connector assembly hood that provides environmental protection to the electrical connector assembly.

FIG. 3 shows a right side view of the electrical connector assembly 101 or cable assembly. This view provides detail on the environmental protection classification IP 65 housings 110*a* and 110*b* that houses all the connector headers and also seals the housings 110*a* and 110*b* against water, dust, and potential hazard ingress.

Figure 4:
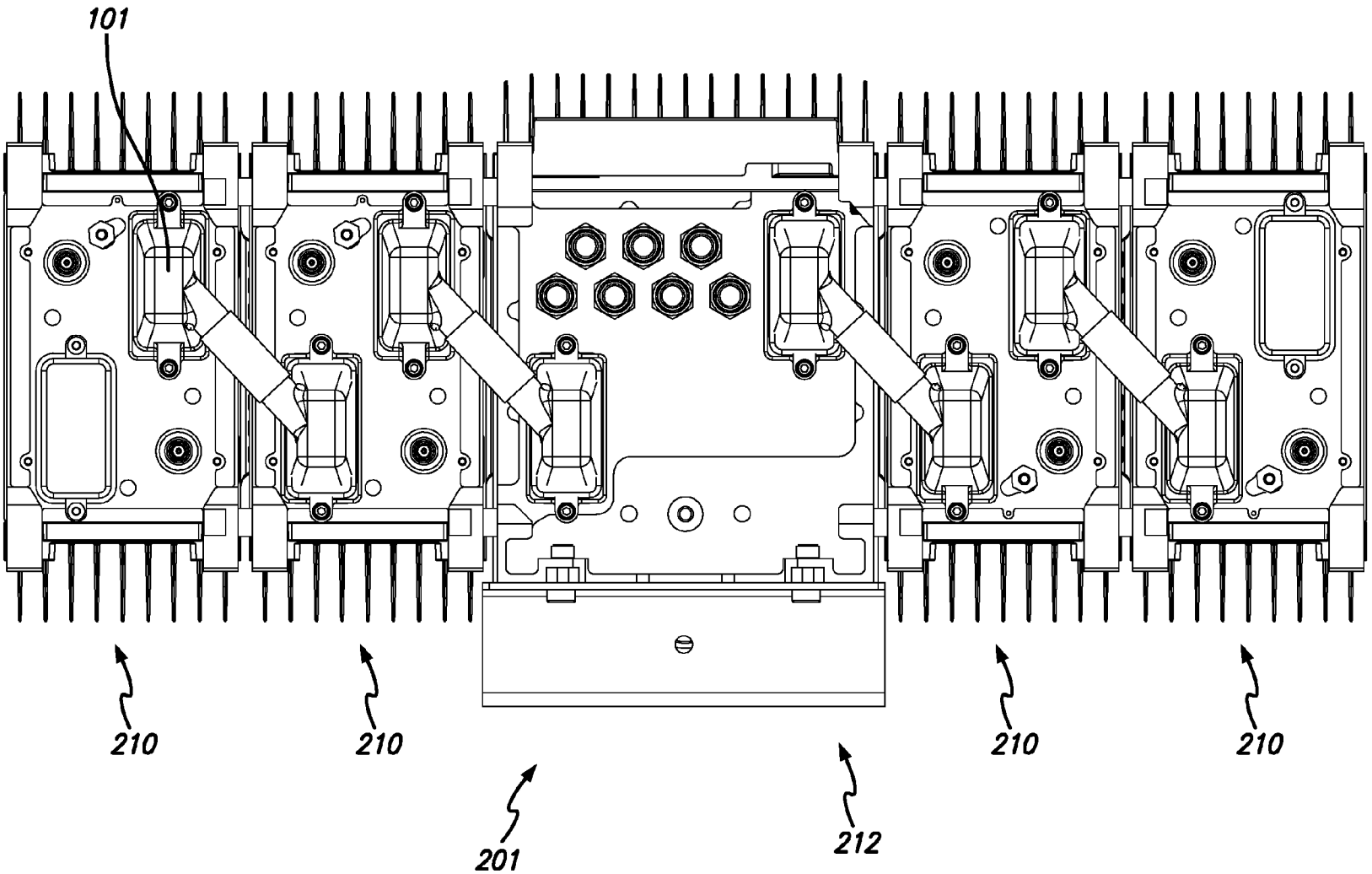
FIG. 4 is a bottom view of the electrical connector assemblies employed in a modular RF communications system.

FIG. 4 is a bottom view of an exemplary employment of plural of the above described electrical connector assemblies 101 or cable assemblies in a modular communications system 201. Teachings related to modular systems employing cable assemblies disclosed in U.S. Provisional Patent Application Ser. No. 61/507,783 filed Jul. 14, 2011 may be employed herein and the disclosure of which is incorporated herein by reference in its entirety.

FIG. 4 shows four exemplary electrical connector assemblies 101 interconnecting adjacent modules such as between two RF modules 210 or between an RF module 210 and a base unit module 212. Each electrical connector assembly 101 mates with a connector on the modular system 201 and forms an environmental seal as a result of the sealing gasket or O-ring 118 placed in the recessed groove 116 as shown in FIG. 1. As the electrical connector assembly 101 is mated with the connector on the modular system 201, mechanical fasteners 124 engage with the connector on the modular system 201 and create a seal as a result of the O-ring 118 being pressed against the recessed groove 116 and the modular system 201. The mechanical fasteners 124 are captively held in the tabs 120 of the rigid housings 110*a* and 110*b*.

The separation of the housings 110*a* and 110*b* may be adjusted to facilitate installation. As shown in FIG. 2, housings 110*a* and 110*b* each have a tubular sleeve 126 which couple with a flexible tubular section 140. In an embodiment, the flexible tubular section 140 comprises a baffle tube or bellows tube having multiple pleats which may be expanded or contracted in length to change the spacing between the housings 110*a* and 110*b*. The flexible tubular section 140 thus expands or contracts along the length of the tubular section. In an embodiment, the tubular sleeves 126 may be affixed to the flexible tube section 140 through the use of adhesives such as epoxies or glues for example. In an embodiment, an O-ring is provided around the lip off the tubular sleeve 126 or the tubular section 140 to provide the IP 65 seal in the mated condition.

As discussed, FIG. 2 depicts the RF and power header 150 and the digital communication header 170. In a non-limiting example, the RF and power header 150 has six RF connectors 152 and two power connections 160 in a single in-line package in an embodiment. The digital communications header 170 has digital communication connectors 172 in a dual in-line package in an embodiment. It shall be understood that other configurations are contemplated including employing other packaging and quantities of RF connectors 152, power connections 160, and digital communication connectors 172.

As stated above, the electrical connector assembly 101 may exhibit a minimum radio frequency isolation of RF paths of 40 dB minimum between adjacent RF connection paths and a radio frequency isolation of 60 dB minimum between non-adjacent RF connection paths. To meet the RF isolation requirements, a proper selection of the RF connector and type of cable may be required. In addition, the placement of the different RF signal types in the RF and power header 150 header plays a role. For example the connectors 156 carrying the RF FON routing is on opposite ends of the RF and power header 150 to provide the greatest isolation, while the connectors 154 which carry the communication modem and measurement/receive signals are the inner portion of the RF and power header 150. For example, in an embodiment, this performance may be achieved by disposing the RF connectors linearly in the RF and power connector header 150 with the RF connectors conducting signals having a high power level 156 surrounding the RF connectors conducting signals having a lower power level 154 as shown in FIG. 2.

Figure 5:
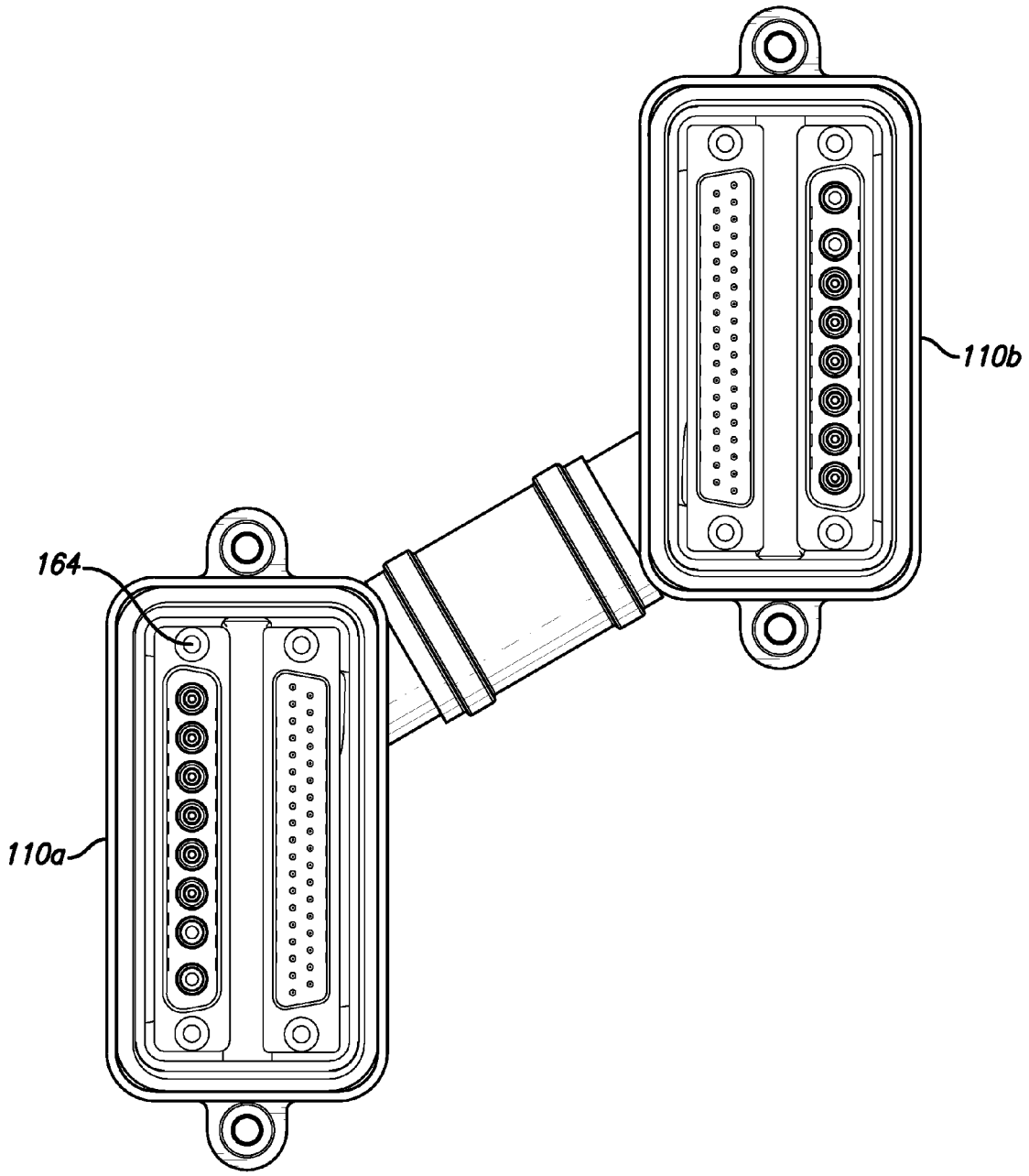
FIG. 5 is a top view of the electrical connector assembly illustrating the floating mount washers.

FIG. 5 is a top view of the electrical connector assembly 101 illustrating the floating mount washers 164. As discussed above, the RF and power header 150 and the digital communication header 170 may employ a floating connector to facilitate blind mate connections. In an embodiment, one connector header is stationary while the other header may be mounted by using a floating nut plate. In an embodiment, the headers 150 and 170 may employ floating mount washers 164 in the mounting holes of the headers 150 and 170. As known in the art, a floating mount washer 164 may comprise two flat washers positioned on a top side and a bottom side of the header. The flat washers are connected by a sleeve that rests within the mounting holes of the headers 150 and 170. The sleeve prevents the flat washers from making secure contact with the headers 150 and 170, and therefore, allow the headers 150 and 170 to move freely in a plane parallel with the mating surface 114.

Figure 6:
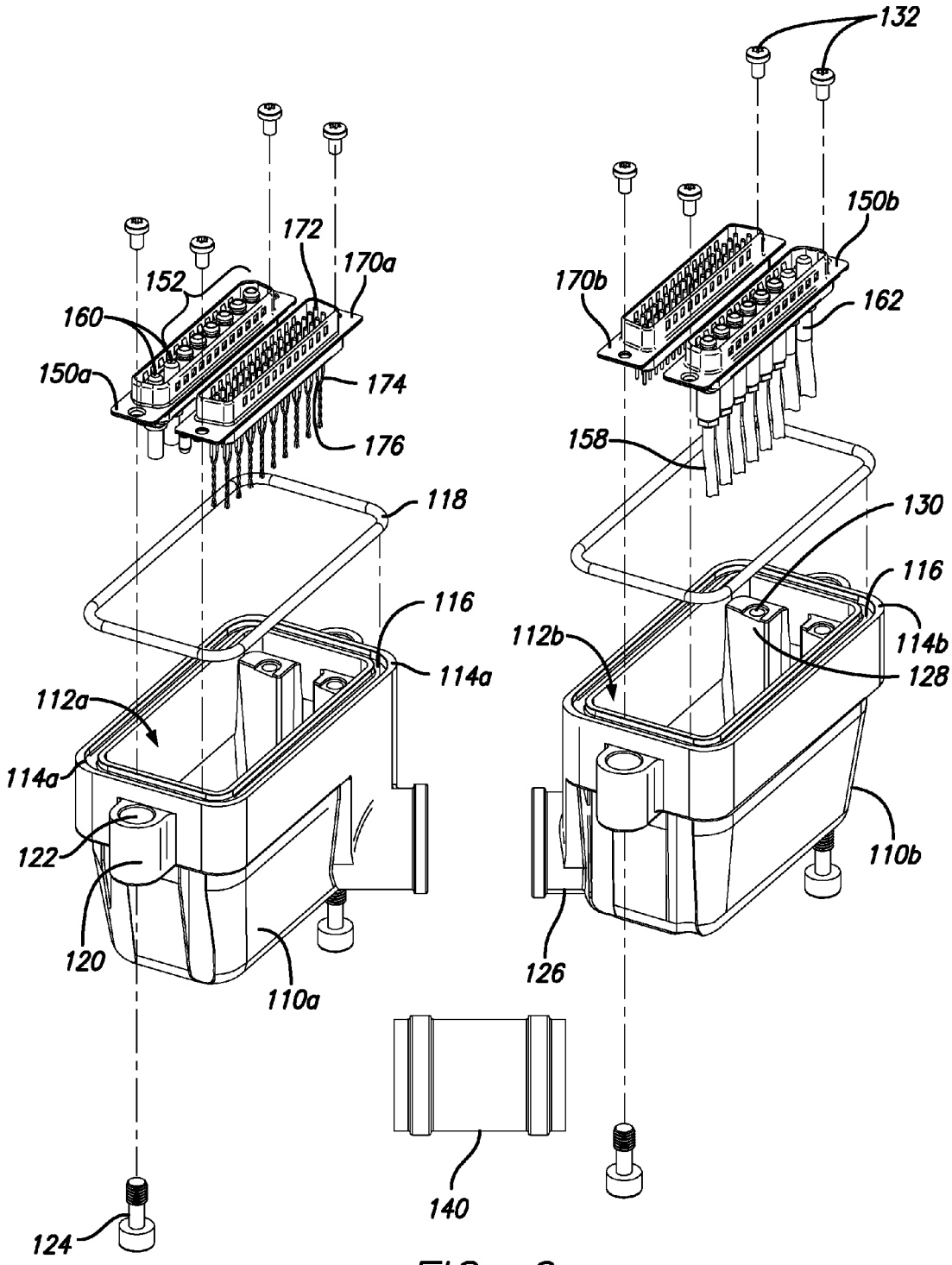
FIG. 6 is an exploded, perspective view of the electrical connector assembly.
Figure 7A:
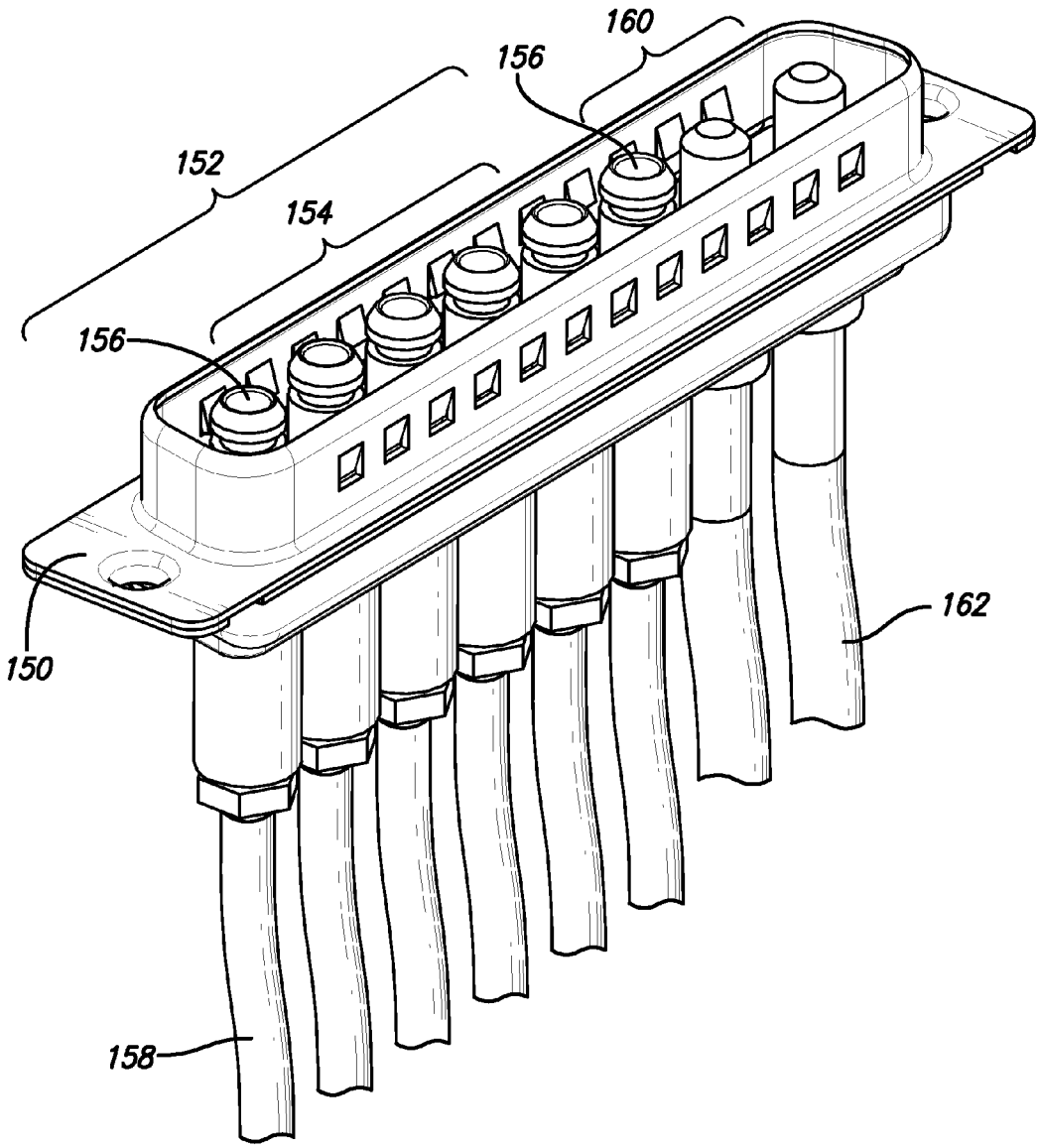
FIG. 7A is a perspective view of the RF and power connector header.
Figure 7B:
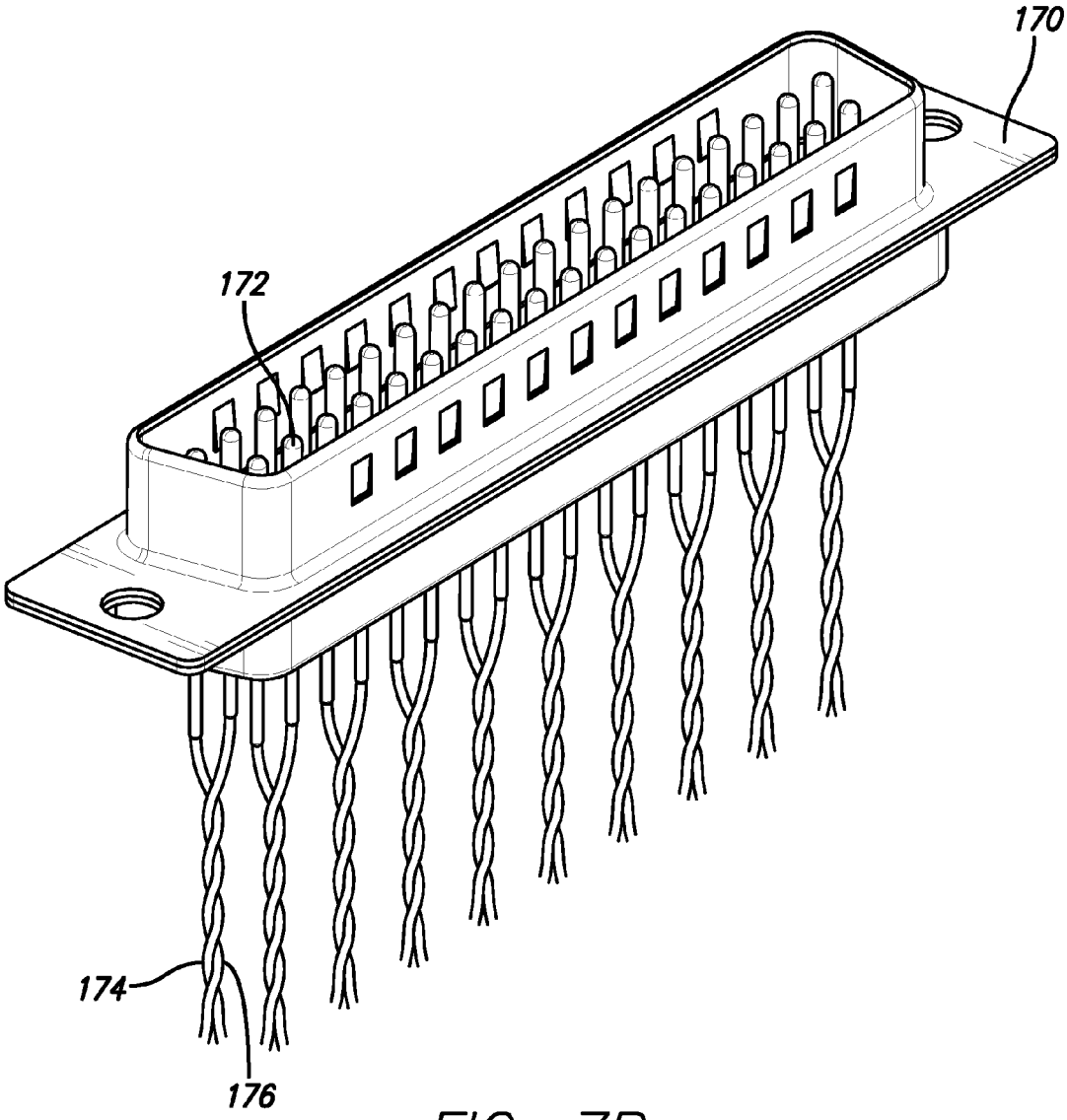
FIG. 7B is a perspective view of the digital communication header.

FIG. 6 is an exploded, perspective view of the electrical connector assembly, and FIGS. 7A and 7B are perspective views of the connections to the RF and power header 150 and the digital communication header 170, respectively. The electrical connector assembly 101 comprises first rigid housing 110*a*, a second rigid housing 110*b*, and a flexible tubular section 140. The first rigid housing 110*a* has a first cavity 112*a* which defines a first opening on a first mating surface 114*a*. The first rigid housing 110*a* secures a plurality of first connectors including a plurality of first RF connectors 152, a first power connector 160, and a plurality of first digital communication connectors 172. The digital communication connectors 172 may comprise female sockets as shown in FIG. 2 or male pins as shown in FIG. 6 for example. The first rigid housing 110*a* has a RF and power header 150*a* (i.e., a first header) which houses the first RF connectors 152 and the first power connector 160 and has a digital communication header 170*a* (i.e., a second header) which houses the first digital communication connectors 172. The first rigid housing encloses a plurality wires, cable or other conductors. The connectors are electrically coupled to the corresponding conductors.

Likewise, the second rigid housing 110*b* has a second cavity 112*b* which defines a second opening on a second mating surface 114*b*. The second rigid housing 110*b* houses a plurality of second connectors including a plurality of second RF connectors 152, a second power connector 160, and a plurality of second digital communication connectors 172. The second rigid housing 110 has a RF and power header 150*b* (i.e., a third header) which houses the second RF connectors 152 and the second power connector 160. The second rigid housing 110*b* has a digital communication header 170*b* (i.e., a fourth header) which secures the second digital communication connectors 172. The second connectors are electrically coupled to the corresponding conductors.

A hollow flexible tubular section 140 couples to the tubular sleeve 126 extending away from the first rigid housing 110*a* and second rigid housing 110*b*. The hollow flexible tubular sleeve encloses and provides a path for the conductors between the two housings 110*a* and 110*b*.

As discussed above, the electrical connector assembly 101 may meet EMI and EMC requirements. In order to meet the ETSI/FCC standards for EMI/EMC leakage, the wires connected to the digital communication connectors 172 are twisted wire pairs that carry the high-speed digital signal such as Ethernet signals. For example, in one or more embodiments, each of the conductors such as wire 174 that is connected to the digital communication connector 172 is twisted about an adjacent conductor such as wire 176. The twisted wire-pairs may meet CAT-5 requirements which requires 5 wire twists per inch minimum.

The present invention has been described primarily as structures and methods for interconnects for wireless and fiber optic systems. The description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. An electrical connector assembly, comprising:

a housing having a cavity which defines a mating opening on a mating end and a coupling opening at an opposite end;

a plurality of RF connectors disposed within the housing near the mating opening;

at least one power connector disposed within the housing near the mating opening;

a plurality of digital communication connectors disposed within the housing near the mating opening;

a first header securing the RF connectors and the power connector, the first header coupled to the housing, wherein the first header further comprises a first mounting hole, a first mounting surface and a first set of floating mount washers connected together by a sleeve that rests within the first mounting hole, the first set of floating mount washers allowing movement of the first header in a plane parallel with the first mounting surface; and a second header securing the digital communication connectors, the second header coupled to the housing, wherein the second header further comprises a second mounting hole, a second mounting surface and a second set of floating mount washers connected together by a sleeve that rests within the second mounting hole, the second set of floating mount washers allowing movement of the second header in a plane parallel with the second mounting surface.

2. The electrical connector assembly as set out in claim 1, further comprising:

a plurality of insulated wires each electrically coupled to a corresponding digital communication connector, each insulated wire twisted about an adjacent insulated wire.

3. The electrical connector assembly as set out in claim 2, wherein said each insulated wire is twisted a minimum of 5 twists per inch about an adjacent insulated wire.

4. The electrical connector assembly as set out in claim 1, wherein the plurality of RF connectors are disposed linearly in the first header, wherein a first portion of the plurality of RF connectors that conduct signals having a high power level surround a second portion of the plurality of RF connectors that conduct signals having a lower power level.

5. The electrical connector assembly as set out in claim 1, wherein the housing further comprises:

a recessed groove formed around a perimeter of the opening in the housing;

two or more tabs coupled to the housing and extending away from the opening, each tab having a through hole; and, two or more mechanical fasteners each held captive in a corresponding through hole in the tabs.

6. The electrical connector assembly as set out in claim 1, wherein the first header comprises a single inline header and the second header comprises a dual inline header.

7. An electrical connector assembly, comprising:

a first rigid housing having a first cavity which defines a first opening on a first mating surface, the first rigid housing securing a plurality of first connectors including a plurality of first RF connectors, a first power connector, and a plurality of first digital communication connectors, the first rigid housing having a first header securing the plurality of first RF connectors and the first power connector, the first rigid housing having a second header securing the plurality of first digtal communication connectors, the first rigid housing enclosing a plurality of first conductors wherein each of the plurality of first RF connectors, the first power connector and the plurality of first digital communication connectors is electrically coupled to a corresponding one of the plurality of first conductors, the first rigid housing further comprising a first tubular sleeve;

a second rigid housing having a second cavity which defines a second opening on a second mating surface, the second rigid housing securing a plurality of second connectors including a plurality of second RF connectors, a second power connector, and a plurality of second digital communication connectors, the second rigid housing having a third header securing the plurality of second RF connectors and the second power connector, the second rigid housing having a fourth header securing the plurality of second digital communication connectors, the first rigid housing enclosing a plurality of second conductors wherein each of the plurality of second RF connectors, the second power connector and the plurality of second digital communication connectors is electrically coupled to a corresponding one of the plurality of second conductors, the second rigid housing further comprising a second tubular sleeve; and, a hollow flexible tubular section expandable in a length direction and coupling the first tubular sleeve of the first rigid housing to the second tubular sleeve of the second rigid housing, the flexible tubular section enclosing and providing a path for the conductors.

8. The electrical connector assembly as set out in claim 7, wherein:

the first header further comprises a first set of floating mount washers, the first set of floating mount washers allowing movement of the first header in a plane parallel with the mounting surface;

the second header further comprises a second set of floating mount washers, the second set of floating mount washers allowing movement of the second header in the plane parallel with the mounting surface;

the third header further comprises a third set of floating mount washers, the third set of floating mount washers allowing movement of the third header in the plane parallel with the mounting surface; and, the fourth header further comprises a fourth set of floating mount washers, the fourth set of floating mount washers allowing movement of the fourth header in the plane parallel with the mounting surface.

9. The electrical connector assembly as set out in claim 7, wherein each conductor coupled to the digital communication connector is twisted about an adjacent conductor coupled to the digital communication connector.

10. The electrical connector assembly as set out in claim 9, wherein each conductor coupled to the digital communication connector is twisted a minimum of 5 twists per inch about an adjacent conductor coupled to the digital communication connector.

11. The electrical connector assembly as set out in claim 7, wherein the plurality of first RF connectors are disposed linearly in the first header, wherein a first portion of the plurality of first RF connectors that conduct signals having a high power level surround a second portion of the plurality of first RF connectors that conduct signals having a lower power level.

12. The electrical connector assembly as set out in claim 7, wherein each of the first and second housings further comprises:

a recessed groove formed around a perimeter of each of the openings in the housing, the groove having a depth parallel with a mating direction generally perpendicular to the mating surface;

two or more tabs coupled to each of the housings and extending away from the opening, each tab having a thorough hole formed in the mating direction; and, two or more mechanical fasteners each held captive in a corresponding through hole in the tabs.

13. The electrical connector assembly as set out in claim 7, wherein the first header comprises a single inline header and the second header comprises a dual inline header.

14. A modular electronics and electrical connector assembly, comprising:

as first electronics module;

a first rigid housing removably coupled to the first electronics module having a first cavity which defines a first opening on a first mating surface, the first rigid housing having a first header securing a plurality of first RF connectors, the first rigid housing having a second header securing the first digital communication connectors, the first rigid housing enclosing a plurality of conductors wherein the plurality of first RF connectors and the plurality of first digital communication connectors are electrically coupled to a corresponding first conductor, the first rigid housing further comprising a first tubular sleeve;

a second electronics module;

a second rigid housing removably coupled to the second electronics module and having a second cavity which defines a second opening on a first mating surface, the second rigid housing having a third header securing a plurality of second RF connectors, the second RF digital communication connectors electrically coupled to a corresponding second conductor, the second rigid housing further comprising a second tubular sleeve; and, a flexible tubular section coupling the first tubular sleeve of the first rigid housing to the second tubular sleeve of the second rigid housing, the flexible tubular section enclosing and providing a path for the conductors.

15. The modular electronics and electrical connector assembly as set out in claim 14, further comprising:

means for providing a blind mate connection of the first housing to a communication system;

means for providing environmental protection of a connection of the first housing to the communication system; and, means for providing RF isolation of the RF connectors and conductors.

16. The modular electronics and electrical connector assembly as set out in claim 15, wherein the means for providing a blind mate connection of the first housing to the communication system include the first header having a first set of floating mount washers and the second header having a second set of floating mount washers.

17. The modular electronics and electrical connector assembly as set out in claim 15, wherein the means for providing environmental protection of a connection of the first housing to a communication system includes a recessed groove formed around a perimeter of the first opening in the first housing, the groove having a depth parallel with the mating direction, and a sealing gasket disposed in the groove.

18. The modular electronics and electrical connector assembly as set out in claim 15, wherein the means for providing RF isolation of the RF connectors and conductors include RF connectors disposed linearly in the first and second headers, wherein RF connectors conducting signals having a high power level surround RF connectors conducting signals having a lower power level.

19. The modular electronics and electrical connector assembly as set out in claim 14, wherein the system comprising the coupled first and second electronics modules comprises a modular RF repeater.

* * * * *